US006763877B2

(12) United States Patent
Krause et al.

(10) Patent No.: US 6,763,877 B2
(45) Date of Patent: Jul. 20, 2004

(54) METHOD FOR THE CONTROLLED TEMPERING OF A CASTING TROUGH AND A CASTING TROUGH FOR CARRYING OUT THE METHOD

(75) Inventors: Andreas Krause, Osnabrück (DE); Dirk Rode, Osnabrück (DE); Uwe Quadfasel, Osnabrück (DE); Hartmut Olemann, Osnabrück (DE); Ralph Frankenberg, Osnabrück (DE); Hubertus Brüning, Mettingen (DE)

(73) Assignee: KM Europa Metal AG, Osnabruck (DE)

( * ) Notice: Subject to any disclaimer, the term of this patent is extended or adjusted under 35 U.S.C. 154(b) by 247 days.

(21) Appl. No.: 10/004,940

(22) Filed: Dec. 3, 2001

(65) Prior Publication Data

US 2003/0075249 A1 Apr. 24, 2003

(30) Foreign Application Priority Data

Dec. 1, 2000 (DE) ..... 100 59 744

(51) Int. Cl.[7] ..... B22D 11/10

(52) U.S. Cl. ..... 164/337; 164/447; 266/196; 266/275

(58) Field of Search ..... 264/30; 164/337, 164/335, 447; 266/275, 196, 231

(56) References Cited

U.S. PATENT DOCUMENTS 3,612,720 A * 10/1971 von Starck ..... 417/50
3,684,402 A * 8/1972 von Starck ..... 417/50
3,754,634 A * 8/1973 Gerbig et al. ..... 164/337
3,773,503 A * 11/1973 Kranz et al. ..... 420/499
3,807,484 A * 4/1974 von Starck ..... 164/500
4,475,721 A * 10/1984 Pamart ..... 266/236
4,635,706 A * 1/1987 Behrens ..... 164/500
5,084,089 A * 1/1992 Zekely et al. ..... 75/10.12
5,553,660 A * 9/1996 Krause et al. ..... 164/468
5,902,509 A * 5/1999 Bruckner et al. ..... 219/644
6,386,270 B1 * 5/2002 Kandev et al. ..... 164/471

FOREIGN PATENT DOCUMENTS

DE DT 2628135 * 1/1977
DE 3221241 A1 * 12/1983
JP 62-296942 * 12/1987
JP 63-209462 * 8/1988
JP 02-037943 * 2/1990
JP 04-295593 * 10/1992
JP 11-092837 * 4/1999

* cited by examiner

*Primary Examiner*—John J. Zimmerman
(74) *Attorney, Agent, or Firm*—Kenyon & Kenyon

(57) ABSTRACT

A method and device for the controlled tempering of a casting trough integrated between a supply vessel for a molten metal (e.g., copper or a copper alloy), and at least one continuous casting mold. The trough walls and the trough floor of the casting trough are at least partially provided with a lining layer having a specific electrical resistance between $10^{-1}$ Ω·m to $10^{-6}$ Ω·m and being resistant to the heat of the molten metal. The lining layer is inductively heated by an electrical heating device arranged around the lining layer.

8 Claims, 3 Drawing Sheets

METHOD FOR THE CONTROLLED TEMPERING OF A CASTING TROUGH AND A CASTING TROUGH FOR CARRYING OUT THE METHOD

FIELD OF THE INVENTION

A method and device for tempering a casting trough; specifically a method and device for tempering a trough without causing the release of potentially hazardous substances to the immediate environment.

BACKGROUND OF THE INVENTION

Occupational hazards exist with regard to exposure to gases and particulates in a continuous casting plant for molten metals such as copper or copper alloys. Some of these hazards are related to the tempering of the casting trough of the continuous casting plant. The casting trough is the part in which the molten metal flows from a supply vessel—such as a melting furnace, casting furnace, or a ladle—to a continuous casting mold where the molten metal then solidifies into a metal billet.

Before the start of the continuous casting process, and thus the filling with the molten metal, it is necessary to heat the casting trough intensively. Only then can it be ensured that the molten metal will properly reach the continuous casting mold without prematurely solidifying.

It is a known method to heat a casting trough with gas burners when casting molten metals of copper or copper alloys. This procedure is feasible at an acceptable industrial cost and at relatively high heating rates.

Nonetheless, heating with gas burners has a number of disadvantages. First, there is often a considerable generation of noise, the cause of which is the high velocity of the combustion gas emerging from the burner jets. In addition, due to the high flow speeds of the combustion gases in the burner area, and due to thermal convection, oxidized cast metal, volatile components of the smelting residues, dust particles in the form of slag particles, and pulverized fluxing agents can be swirled up and may reach the environment of the continuous casting plant, where they can result in a detriment to the health of the persons employed there. Moreover, the hot flames of the gas burners usually break out of the casting trough and thus contribute to an appreciable occupational exposure as the result of heat.

An additional problem in using gas burners is the precision of temperature regulation of the walls of the casting trough.

Before the process starts, the temperature of the walls of the casting trough to be heated is not always precisely uniform since the burner flames themselves do not have the same temperatures throughout. This situation results from the existence of locally varying combustion zones with temperatures that deviate from one another within the burner flame. This results in locally varying temperatures on the walls of the casting trough. The position of the varying temperature zones is a function of the flame control within the combustion chamber. To an essential degree, the flame control is the consequence of the geometry of the combustion chamber and of the gas burner. In the case of the casting trough, the combustion chamber is the casting trough, the profile of which can be subject to changes, specifically by wear of the lining or trough cover as a result of the effect of heat and molten metal as well as by caking of metal slags and metal crusts. The burner nozzles are also subject to wear by the effect of heat.

As a consequence of the above-described local non-uniformities, the temperature of the walls of the casting trough cannot reliably be set in a reproducible manner so that, on the whole, the mean wall temperature is precisely uniform in each casting process. The consequence of this is that during the casting operation, the molten metal flowing through the casting trough gives off heat to the walls and/or absorbs heat from them in a different manner in the different casting runs.

Also, the temperature of the molten metal within the casting trough cannot be regulated sufficiently fast enough by directly heating the molten metal with gas burners since, for example, the heat transmission at the boundary surface of the burner flames/molten metal is not sufficiently great.

In practice, it is therefore the case that the molten metal gives off heat while flowing through the casting trough. The extent of the cooling of the molten metal is usually greater at the start of the casting than later when the walls of the casting trough have been uniformly heated by absorption of heat from the molten metal. The consequence of this is that the solidification process originates in the casting mold from temperatures of the molten metal that change during the casting process and are not so readily susceptible to regulation.

This results in additional disadvantageous effects.

During cooling, the cast molten metal in the form of the metal billet naturally experiences a contraction of volume. Since cooling in the interior of the metal billet inevitably occurs differently in comparison with the areas near the surface, this results in internal mechanical stresses in the metal billet, which influence the machinability of the material provided from the molten metal to a varying degree.

Thus, if the material strength is exceeded, cracks may occur within the material to be machined, which in many cases, results in production problems or disadvantageous properties of the end products. The formability of the material is also not uniform since it is dependent on the stresses in the metal billet. The result of this is that for error-free production, the machining process must be designed in such a way that even material with unfavorable stress states or low formability can still be machined. This, however, imposes economic limitations on machining.

The methods known heretofore include additional heating methods that are applied in different cases of applications for metallurgical troughs. The use of such heating methods can avoid at least some of the problems that are characteristic of heating with gas burners.

Thus, for example, known methods include heating casting troughs of vacuum furnaces with radiant heaters arranged above them. This method is based on glowing metal wires and is customary in vacuum melting and casting plants. Radiant heaters nonetheless have only a relatively low power density so that the heating of a casting trough requires a substantially longer time than with gas burners. Therefore, they are basically suitable only for applications in which adequate time for heating is available. In addition, it must be stated that, due to the low power density, it is impossible to regulate the temperature of a flowing molten metal under the conditions of an industrially operated production process with throughputs of several tons per hour.

Other radiant heaters use glowing silicon carbide rods. In this case also, there is the basic disadvantage of a low current density with the negative effects described above. Since silicon carbide oxidizes and is destroyed relatively rapidly in air, the life of such heating elements is also relatively short. Moreover, they are very sensitive to mechanical stresses and can thus break relatively easily. They are therefore not suitable in connection with the heating of casting troughs as components of continuous casting plants.

Inductive heating of metals is also a widely used technology. It is frequently used in induction melting furnaces. The inductive heating of a molten metal immediately upstream of the continuous casting mold of a continuous casting plant is also known.

Thus, French Patent No. 1,465,577 describes a device in which the molten metal flows from a supply vessel during the continuous casting through a sealed, tubular, refractory supply line to a continuous casting mold and in so doing is inductively heated. The feed pipe is only open at the ends so as to protect the molten metal against a reaction with the ambient air.

However, such a device is only suitable for such special casting plants in which there is a sealed connection between the feed of the molten metal and the continuous casting mold. Its use is not covered in a casting process as is customary with the continuous casting of copper or copper alloys in which the continuous casting mold must be arranged separately and the fill level in the continuous casting mold can be monitored visually. An additional disadvantage is that the continuous casting mold is poorly accessible due to its sealed coupling to a closed feed for the molten metal. It is in fact necessary to clean undesirable slag accumulations, etc. from the mold walls from time to time after casting.

In French Patent No. 1,319,891, a tundish of a continuous casting plant for the continuous casting of steel in particular is described, the tundish being provided with a peripheral inductive coil. This coil performs two functions simultaneously. It causes the molten metal to rotate in quite specific rotary movements for the purpose of improved refining. For this purpose, specific alloying elements are added to the steel melt resulting in chemical reactions and reaction products that are characteristic of the processing of molten steel. This intense and characteristic rotating movement of the melt is obtained at a frequency of 50 to 60 Hertz. The second function is the heating of the molten metal by currents that are produced within the molten metal.

The idea of the French patent is consequently not suitable for the heating of a still empty casting trough between a supply vessel and a continuous casting mold. Since the casting mold does not contain a molten metal, it is also impossible to inject inductive fields. Moreover, this proposal is not reasonably applicable to molten metals that should not be intensively stirred while flowing through a casting trough. Rather, a flow that is as smooth as possible is desirable in many cases when casting molten metals comprised of copper or copper alloys. This allows particles entrained by the molten metal to be precipitated out and undesirable reactions with the ambient air are avoided.

Furthermore, in some cases, plasma heaters are used for casting troughs in the continuous casting of steel in order to preheat the empty casting trough or a tundish for the process start. The relatively high temperatures of the plasma do in fact bring about usable heating times. This type of heating can also be used during casting to adjust the temperature of the molten metal more precisely when it flows through the casting trough. However, the disadvantage with this method is that metal may vaporize due to the very high temperatures of the plasma. Metal vapors are a problem in particular in metals with a high vapor pressure. Consequently, plasma heaters are unfavorable and therefore disadvantageous for copper and copper alloys due to the vaporization of copper and certain highly volatile alloying elements such as zinc and lead.

Finally, a known method is to convey a molten metal through a trough by means of an inductive traveling magnetic field (German Patent No. 2 212 924). This conveying may also act against the force of gravity. In order to convey the molten metal, special linear inductors are affixed below the conveying trough. The conveying trough itself has an electrically non-conductive liner. Such conveyer troughs under the influence of an inductive field of a traveling field are suitable for heating the molten metals flowing through the conveyer troughs, the heating always arising as a byproduct of the conveyance of the molten metal. As a consequence, with such conveyer troughs, the conveyer performance and the heating of the molten metal are always in a certain relation that is specific to the application, e.g., as a function of the lifting height.

SUMMARY OF THE INVENTION

The object of the present invention is to devise a method for the temperature control of a casting trough integrated between a supply vessel for a molten copper or a copper alloy, and at least one continuous casting mold, as well as a casting trough for the implementation of the method. The casting process is performed with process parameters as constant as possible in a favorable process window and it being possible to avoid fluctuations of the temperature of the molten metal so that production problems and the associated disadvantageous properties of the end products can be largely ruled out when material from a cast metal billet is machined.

As far as the attainment of the method-related part of the objective is concerned, it is to be found, according to the present invention, a method is provided for the controlled tempering of a casting trough integrated between a supply vessel for a molten metal that is copper or a copper alloy, and at least one continuous casting mold. The method includes the steps of:

providing at least a partial lining on at least one trough wall and a trough floor of the casting trough, the partial lining having a specific electrical resistance approximately between about $10^{-1}$ Ω·m and $10^{-6}$ Ω·m and the partial lining being resistant to heat of the molten metal; and inductively heating the lining layer by an electrical heating device that is arranged outside the lining layer.

The invention also makes it possible for the first time to heat empty casting troughs as components of continuous casting plants for molten copper or copper alloys by inductive means.

With the method according to the present invention, it is immaterial if the casting trough routes the molten metal to a continuous casting mold or to several casting molds in a multiple continuous casting plant. Also, it is not necessary to convey the molten metal in the casting trough since the level of the surface of the molten metal drops in the direction of flow due to the force of gravity.

In the method according to the present invention, the interior trough walls and the trough floor of the casting trough are at least partially provided with a lining layer having a specific electrical resistance between $10^{-1}$ Ω·m and $10^{-6}$ Ω·m, the character of the lining layer also being designed in such a manner that it is adequately resistant to the heat of the molten metal.

Moreover, the lining layer is combined with a heating device arranged around the casting trough.

In this connection, the lining layer is selected to have a sufficiently high conductivity so that sufficient inductively generated heating currents can flow. Moreover, the lining layer inductively coupled to the heating device is specifically geometrically designed so that a sufficiently large surface area of the space accommodating the molten metal in the casting trough is covered in order to ensure adequate heating.

Such a method has a number of advantages. The inductive heating keeps the occupational exposure caused by noise, dust and heat noticeably lower than heating with gas burners. At the same, it makes a uniform temperature of the walls possible. Consequently, the temperature of the empty casting trough can be readily adjusted during heating in a reproducible manner. The effect of this procedure is that the heat exchange between the molten metal and the walls can be better controlled during the subsequent filling of the casting trough with the molten metal and at the start of casting. Correspondingly, the process window of the optimum process parameters can then also be reliably attained in a reproducible manner.

In addition to the controlled uniform heating of the empty casting trough, the method according to the present invention also makes it possible to level out temperature fluctuations of the molten metal after the casting trough is filled with the molten metal. This purpose is served in particular in an embodiment wherein the inductive heating of the lining layer is controlled or regulated.

For this purpose, for example, the temperature of the molten metal can be continuously measured by temperature probes such as thermocouples submerged in the molten metal. A control circuit then adjusts the heat output of the inductive heating device at every moment so that the temperature of the casting trough is nearly constant after flow is initiated in the casting trough. This results in a nearly uniform process with particularly low fluctuations, which makes it possible to reproducibly set an extremely uniform solidification structure of the metal billet, to which the subsequent forming and machining processes of the material separated from the metal billet can be adapted in an optimum manner.

With the exception of the examples mentioned from the known methods, strong turbulence of the molten metal within the casting trough is undesirable in the continuous casting of molten metals of copper and copper alloys. Contact of the molten metal with the ambient air would have unfavorable effects on the properties of the molten metal. Turbulence also makes the floating of entrained and undesirable particles to the surface difficult. Consequently, in one embodiment, due to the frequency used, the heating device is designed for this purpose in such a way that the predominant portion of the induced power is converted into heat within the lining layer. The heating of the molten metal then takes place by conductive heat transport from the walls into the molten metal.

Moreover, it has been recognized that an important prerequisite for a good result in starting the casting process is a uniformly high temperature of the casting trough, which must be set reproducibly and is as close as possible to the melting point of the molten metal. According to the features of claim 4, the temperature of the lining layer of the casting trough should therefore be inductively heated to a point corresponding to more than 50%, preferably more than 80% of the liquidus temperature in ° C. of the molten metal before the start of casting. With a casting trough that can be heated inductively, this procedure is reliable and can be accomplished within acceptable heating times.

Internal tests have also shown that when the method according to the present invention is applied, surprisingly, additional advantages with a great time delay occur that affect the subsequent casting process, which follows the heating phase and the start-up of the process.

The quality of the material obtained in the continuous casting method is dependent on, among other things, the number of casting defects, pores, internal incipient structural cracks, inclusions and other structural defects. The tests show surprisingly that the quality of the cast structure is better than when a casting trough is heated with gas burners not only immediately after the start of casting within the first 40 cm of a cast ingot but also much later, e.g., after more than one additional meter of casting length. From the point of view of the present invention, the reason for this is seen in that the inductive heating of the casting trough attains a process state with improved stability relatively early.

It has also been shown that it was possible to increase the speed during the starting phase by up to approximately 20%.

Heretofore, the casting process was started at a low drawing speed since discontinuities in the cast structure such as pores or cracks can occur, in the foot area in particular. In many cases, the casting speed was limited by the occurrence of internal mechanical stresses during cooling in the cast ingot, which increase as the casting speed increases and finally result in cracks above a specific critical speed when the internal stresses exceed the material's strength.

During the process start, the solidification progress is still relatively far from the stationary state, which as a function of the shape to be cast, is frequently not attained until after 0.5 m to 2 m. Therefore, the drawing speed is increased gradually or step-wise; it being necessary to ensure that the critical casting speed is not reached.

Owing to the inductive heating of the casting trough, there is now the possibility according to the present invention to shift this critical speed to higher values during the startup phase.

According to the teaching of the present invention, the reduced contamination of the molten metal when using inductive heating as compared to heating with combustion gases and the overall more uniform temperature control during heating and the start of casting play an essential role in this since a reproducibly defined process state is attained in this manner. Also, the controlled inductive heating of the walls of the casting trough during the casting process make it possible to set the optimum process window more exactly if a control circuit is used for this purpose with which the temperature of the molten metal is continuously measured and regulated by the inductive heating device.

A casting trough is also disclosed that has at least one trough wall attached to a trough floor for holding a molten metal. An interior lining layer is disposed on at least one-third of an interior surface of the casting trough. The interior lining layer is resistant to a heat of the molten metal. The interior lining layer has a specific electrical resistance approximately between $10^{-1}$ Ω·m and $10^{-6}$ Ω·m and a thickness ranging approximately between 9 mm and 150 mm. Also provided is a heating device having conductors that are energized with electric current. The conductors are arranged circumferentially at least in a longitudinal direction of the at least one trough wall, so that the lining layer can be heated by the device.

The influence of a fluctuating or irregular mean wall temperature is particularly troublesome if the ratio of the wall surface to the trough volume is comparatively great. Thus the influence of the varying wall temperatures, e.g., in a long, narrow casting trough is particularly high and is correspondingly lower in a compact short, wide and deep casting trough. The present invention therefore calls for the ratio of the length of the casting trough to its width to be equal to or greater than 3. These dimensions are adapted to the maximum dimensions of the area of the casting trough that come into contact with the molten metal.

Advantageously, the electrical heating device extends in the form of an induction coil in a horizontal plane around the casting trough, the coil axis being perpendicular to the longitudinal axis of the casting trough. In this connection, however, it is essential for the casting trough to be readily accessible from above since the molten metal must be covered with flux and the casting trough must usually be cleaned of metallic residues after a casting operation.

The lining layer, which is inductively coupled to the heating device, specifically satisfies certain geometrical requirements so that an adequate heating power can be induced. Thus the invention provides that the thickness of the lining layer ranges between 9 mm and 150 mm. It has been found to be particularly advantageous if the lining layer has a thickness between 20 mm and 80 mm.

It has shown to be practical if the heat-resistant inner lining layer is made of a material such as graphite, clay graphite, carbon or silicon carbide or of a mixture containing two or more of these single components.

The invention will be explained in further detail below with reference to the exemplary embodiments shown in the drawings in which:

DESCRIPTION OF THE PREFERRED EMBODIMENT

Figure 1:
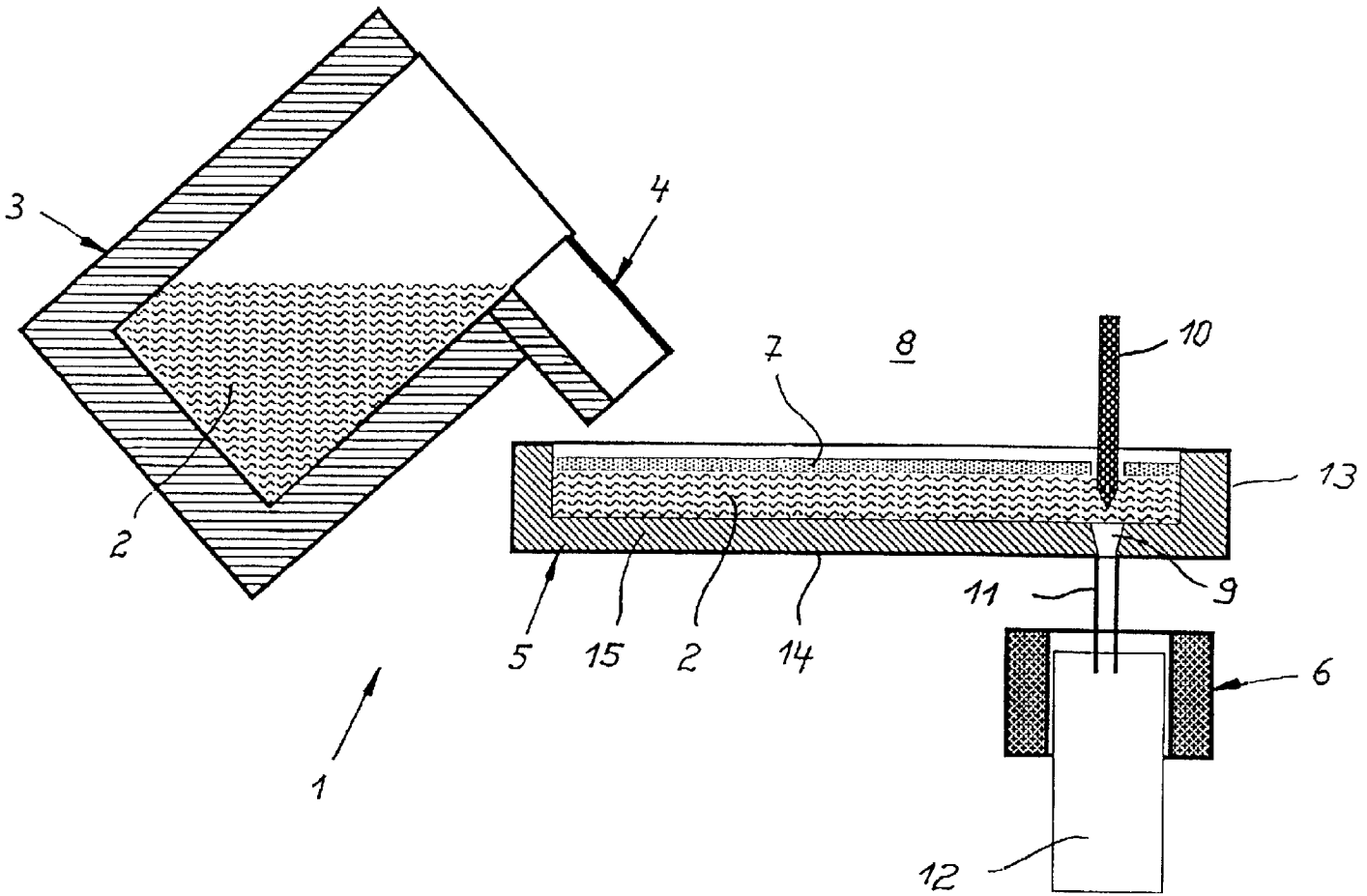
FIG. 1 illustrates a continuous casting plant in a diagrammatic longitudinal section.

The continuous casting plant 1 illustrated diagrammatically in FIG. 1 for a molten copper or a copper alloy 2 initially includes a tilting furnace 3 with casting spout 4. Moreover, continuous casting plant 1 includes a casting trough 5 as a connecting link between furnace 3 and a continuous casting mold 6. Casting trough 5 has, as can be recognized in greater detail in FIGS. 2 and 3, an interior length L, the ratio of which to interior width B is equal to or greater than 3.

Molten metal 2, which has been poured from furnace 3, is located in casting trough 5, molten metal 2 being protected from environment 8 by flux 7.

A discharge outlet 9 is provided at the end of casting trough 5 facing away from furnace 3. A plug 10 is provided so that it is possible to close discharge outlet 9. Via discharge outlet 9 and a connecting feed pipe 11, molten metal 2 is fed to continuous casting mold 6, where it solidifies into a metal billet 12.

As FIGS. 1 to 4 further show, trough walls 13 and trough floor 14 of casting trough 5 are provided with an interior lining layer 15 which is resistant to the heat of molten metal 2. The interior lining layer 15 is made of graphite, clay graphite, carbon, silicon carbide, or any other appropriate substance; or of a mixture with two or more of these single components. Thickness D of lining layer 15 ranges between 20 mm and 80 mm. The material of lining layer 15 preferably has a specific electrical resistance of between $10^{-1}$ Ω·m and $10^{-6}$ Ω m.

Lining layer 15 covers a proportional area of trough walls 13 and trough floor 14 amounting to at least one-third of the interior surface of casting trough 5, which is in contact with molten metal 2. Preferably, lining layer 15 covers more than one-half of the interior surface of casting trough 5.

Figure 2:
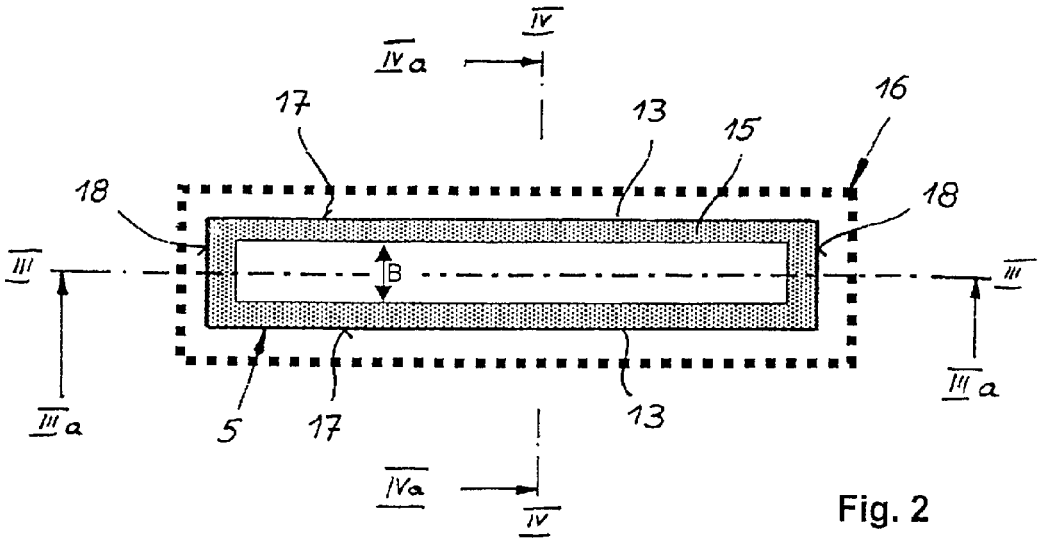
FIG. 2 illustrates a diagrammatic top view of the casting trough of the continuous casting plant of FIG. 1.
Figure 3:
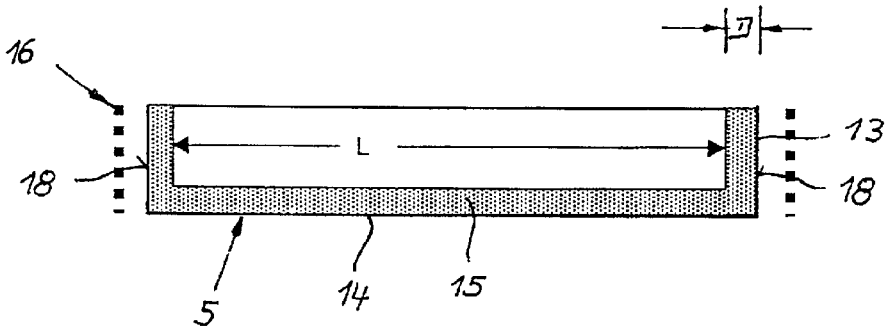
FIG. 3 illustrates a vertical longitudinal section through the casting trough of FIG. 2 seen along Line III—III in the direction of Arrows IIIa.
Figure 4:
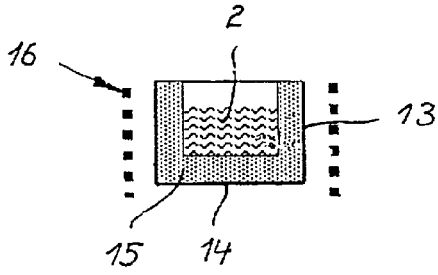
FIG. 4 illustrates a vertical cross-section through the depiction of FIG. 2 seen along Line IV—IV in the direction of Arrows IVa.

Lining layer 15 is heated with an electrical heating device 16 arranged around casting trough 5 according to FIGS. 2 to 4. The current carrying conductors of heating device 16 extend for the most part along side walls 17 and end walls 18 of casting trough 5.

Heating device 16 is operated at a frequency preferably between 1000 hertz and 8000 hertz. The heating of empty casting trough 5 and of molten metal 2 is specifically controlled or regulated so as to ensure in this manner a uniform heating of empty casting trough 5 and to ensure that the molten metal 2 is stirred within casting trough 5 is as little as possible when casting trough 5 is filled.

For the inductive heating of empty casting trough 5, as well as for the heating of molten metal 2, a multitude of directions can be selected by which the currents flow in electrically conductive lining layer 15.

Figure 5:
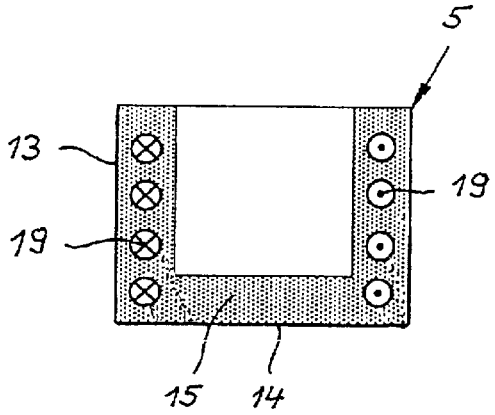
FIG. 5 illustrates diagrammatic cross-sections according to FIG. 4 with the flow direction of an induced electrical current according to a first embodiment.

According to FIG. 5, for example, induced current 19 in lining layer 15 is shown to be flowing away from the observer on the left side. On the right side, induced current 19 in the lining layer is flowing towards the observer.

Figure 6:
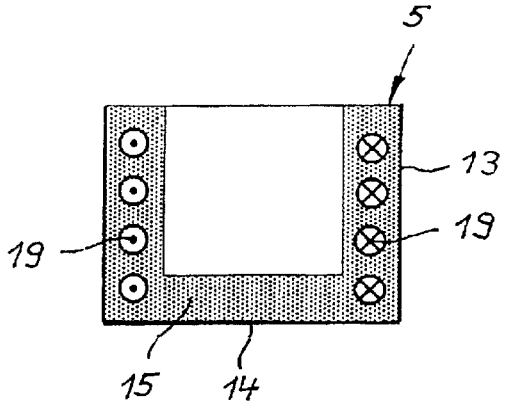
FIG. 6 illustrates diagrammatic cross-sections according to FIG. 4 with the flow direction of an induced electrical current according to a second embodiment.

The current flow is reversed in the embodiment of FIG. 6.

Figure 7:
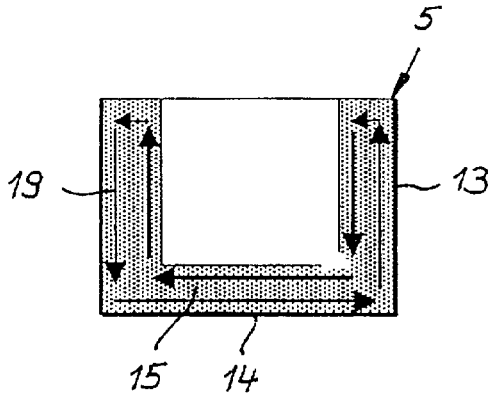
FIG. 7 illustrates diagrammatic cross-sections according to FIG. 4 with the flow direction of an induced electrical current according to a third embodiment.
Figure 8:
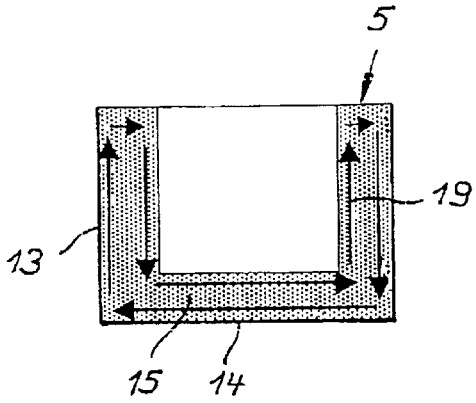
FIG. 8 illustrates diagrammatic cross-sections according to FIG. 4 with the flow direction of an induced electrical current according to a forth embodiment.

In the embodiment of FIG. 7, induced current 19 is flowing counter-clockwise through the walls and the floor of lining layer 15 while it is flowing clockwise in the embodiment of FIG. 8.

Figure 9:
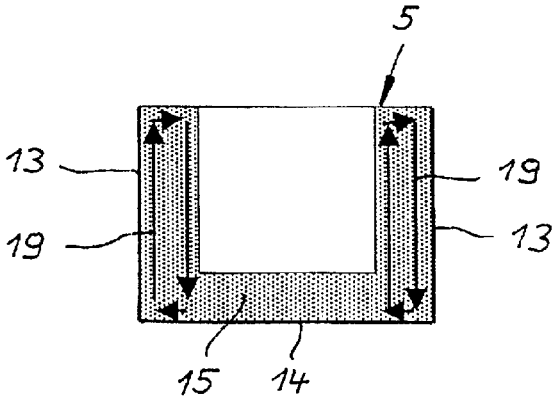
FIG. 9 illustrates diagrammatic cross-sections according to FIG. 4 with the flow direction of an induced electrical current according to a fifth embodiment.

In the embodiment of FIG. 9, induced current 19 is flowing only in the walls of lining layer 15 and in clockwise direction as shown. However, it can also flow counter clockwise or in opposite directions in both walls.

What is claimed is:

1. A method for the controlled tempering of a casting trough integrated between a supply vessel for a molten metal that is copper or a copper alloy, and at least one continuous casting mold, comprising the steps of:

providing at least a partial lining on at least one trough wall and a trough floor of the casting trough, the partial lining having a specific electrical resistance approximately between about $10^{-1}$ Ω·m and $10^{-6}$ Ω·m and the partial lining being resistant to heat of the molten metal; and inductively heating the lining layer by an electrical heating device that is arranged outside the lining layer.

2. The method according to claim 1, further comprising the step of:

regulating the inductive tempering of the lining layer depending on temperature measurements.

3. The method according to claim 1, wherein the heating device is operated at a frequency approximately between 100 Hz and 15,000 Hz.

4. The method according to claim 1, wherein the lining layer is inductively heated to a temperature of more than approximately 50% of the liquidus temperature in degrees Celsius of the molten metal before a start of casting.

5. A casting trough comprising:

at least one trough wall attached to a trough floor for holding a molten metal;

an interior lining layer disposed on at least one-third of an interior surface of the casting trough, the interior lining layer resistant to a heat of the molten metal, the interior lining layer having a specific electrical resistance approximately between $10^{-1}$ Ω·m and $10^{-6}$ Ω·m, the interior lining layer having a thickness ranging approximately between 9 mm and 150 mm; and a heating device having conductors that are energized with electric current, the conductors arranged circumferentially at least in a longitudinal direction of the at least one trough wall, so that the lining layer can be heated by the device.

6. The casting trough according to claim 5 wherein the trough has a length to width ratio equal to or greater than 3.

7. The casting trough according to claim 5, wherein the lining layer has a thickness approximately between 20 mm and 80 mm.

8. The casting trough according to claim 5, wherein the lining layer is fabricated from at least one material selected from the group consisting of graphite, clay graphite, carbon and silicon carbide.

* * * * *